United States Patent [19]

Ralston et al.

[11] 4,018,701

[45] Apr. 19, 1977

[54] PHOSPHOROUS ACID AND ZINC CORROSION INHIBITING COMPOSITIONS AND METHODS FOR USING SAME

[75] Inventors: Paul Hotchkiss Ralston; Bennett Patsy Boffardi, both of Bethel Park, Pa.

[73] Assignee: Calgon Corporation, Pittsburgh, Pa.

[22] Filed: July 31, 1975

[21] Appl. No.: 600,676

[52] U.S. Cl. ..... 252/389 A; 21/2.7 R

[51] Int. Cl.[2] ..... C09K 3/00; C23F 11/00

[58] Field of Search ..... 252/387, 389 A; 21/2.7 R, 2.7 A

[56] References Cited

UNITED STATES PATENTS

| | | | |
|---|---|---|---|
| 3,102,830 | 9/1963 | Duchange | 252/387 |
| 3,431,217 | 3/1969 | Hwa | 252/389 A |
| 3,489,682 | 1/1970 | Lesuer | 252/389 A |
| 3,510,436 | 5/1970 | Silverstein | 252/389 A |
| 3,655,556 | 4/1972 | Allen | 252/389 A |
| 3,803,047 | 4/1974 | Hwa | 252/389 A |
| 3,803,048 | 4/1974 | Hwa | 252/389 A |
| 3,885,914 | 5/1975 | Hollingshad | 252/401 |

*Primary Examiner*—Stephen C. Bentley
*Assistant Examiner*—Donald P. Walsh
*Attorney, Agent, or Firm*—Rudolph J. Anderson, Jr.; Harry E. Westlake, Jr.; Martin L. Katz

[57] ABSTRACT

Use of phosphorous acid ($H_3PO_3$) and zinc to inhibit the corrosion of metals by oxygen-bearing waters.

11 Claims, No Drawings

PHOSPHOROUS ACID AND ZINC CORROSION INHIBITING COMPOSITIONS AND METHODS FOR USING SAME

BACKGROUND OF THE INVENTION

This invention relates to the inhibition of corrosion in water systems which utilize oxygen-bearing waters.

More particularly, this invention relates to the use of compositions comprising phosphorous acid and zinc to inhibit the corrosion of metals in water systems which contain oxygen-bearing waters.

Oxygen corrosion is, of course, a serious problem in any metal-containing water system. The corrosion of iron and steel is of principal concern because of their extensive use in many types of water systems. Copper and its alloys, aluminum and its alloys, and galvanized steel are also used in water systems and are subject to corrosion. We have discovered novel corrosion inhibitors which will inhibit oxygen corrosion in water systems containing such metals.

SUMMARY OF THE INVENTION

We have found that compositions comprising phosphorous acid and zinc are effective corrosion inhibitors. The zinc ion may be supplied in many ways. For example, the zinc ion may be added by utilizing a water-soluble zinc salt, such as, zinc chloride, zinc acetate, zinc nitrate, and zinc sulfate, which forms zinc ions in aqueous solution. The zinc ion may also be supplied by adding zinc just to a solution of the phosphorous acid.

Our corrosion-inhibiting compositions can contain a ratio of phosphorous acid to zinc of from about 1:1 to about 15:1 by weight. The preferred ratio, however, is from about 5:1 to 10:1 by weight. These compositions will effectively inhibit corrosion of metals when maintained in a water system at a concentration of at least about 1 ppm at the above ratios and, preferably, about 5 to 100 ppm. Maximum concentrations are determined by the economic considerations of the particular application.

Suitable polymeric dispersives include water-soluble salts of acrylates and methacrylates, unhydrolyzed or partially hydrolyzed acrylamides, and acrylamidomethyl propane sulfonates such as 2-acrylamido-2-methyl propyl sulfonic acid. The polymers may be homo-, co-, or ter-polymers of any of the aforementioned polymers and may have a molecular weight of from about 500 to about 10,000,000. The preferred molecular weight, however, is about 1,000. Furthermore, compounds such as benzotriazole, tolyltriazole or mercaptobenzothiazole may be added to the final formulation in varying amounts to improve its usefulness in a wider variety of industrial applications where both steel and copper or its alloys are present in the same system or other conditions suggest their use.

The following table illustrates the effectiveness of phosphorous acid when used with and without zinc at the dosages and pH indicated.

These tests were run in synthetic Pittsburgh water. Steel electrodes were used in polarization test cells with the initial pH at 7.0. Inhibitor concentrations were calculated on the basis of active material. The amount of corrosion that had taken place was determined from the current density at the intersection of an extrapolation of the so-called "Tafel" portion of the anodic polarization curve with the equilibrium or "mixed" potential value, usually referred toas the corrosion potential, "$E_{corr}$". Application of Faraday's Law allows a computation of a direct mathematical relationship between the current density at $E_{corr}$, expressed in amperes per square centimeter and a more useful corrosion rate expression such as milligrams of steel consumed per square decimeter of surface per day (m.d.d.) and mils per year (m.p.y.). This relationship is such that a current density value of $4.0 \times 10^{-7}$ amperes/cm$^2$ = 1.0 mg/dm$^2$/day. Further, the m.p.y. value is calculated from the usual formula:

$$\text{m.p.y.} = \text{m.d.d.} \times \frac{1.44}{\text{density}},$$

using a density value of 7.87 g/cm$^3$ for steel. The corrosion rate for steel in this water without inhibitor is 45 mpy.

Table 1

| Dosages (mg/l) | | Corrosion Rate (mpy) |
|---|---|---|
| Phosphorous Acid | Zinc | |
| 50 | | 16 |
| 150 | | 12 |
| 50 | 5 | 1 |

We claim:

1. A composition useful for inhibiting the corrosion of metals in a water system comprising phosphorous acid and zinc

2. A composition as in claim 1 wherein the ratio of phosphorous acid to zinc is from about 1:1 to about 15:1 by weight.

3. A composition as in claim 2 wherein the ratio of phosphorous acid to zinc is from about 5:1 to about 10:1.

4. A composition as in claim 1 which further comprises a member selected from the group consisting of benzotriazole, tolyltriazole and mercaptobenzothiazole.

5. A composition as in claim 1 which further comprises a water-soluble polymer.

6. A composition as in claim 5 wherein the ratio of zinc to polymer is from about 1:1 to about 100:1.

7. A method of inhibiting the corrosion of metals in a water system comprising maintaining in the water of said system at least about 1 ppm of a composition comprising phosphorous acid and zinc.

8. A method as in claim 7 wherein the ratio of phosphorous acid to zinc is from about 1:1 to about 15:1 by weight.

9. A method as in claim 8 wherein the ratio of phosphorous acid to zinc is from about 5:1 to about 10:1.

10. A method as in claim 7 wherein at least 5 ppm of the composition are present.

11. A method as in claim 7 wherein 0.1 ppm of a water-soluble polymer is maintained in said system.

* * * * *